US009976831B2

(12) United States Patent
Badgerow

(10) Patent No.: US 9,976,831 B2
(45) Date of Patent: May 22, 2018

(54) LIMB RETAINER SYSTEM AND ARCHERY BOW COMPRISED THEREOF

(71) Applicant: Strother Archery, Sandusky, MI (US)

(72) Inventor: Mitchell Thomas Badgerow, Sandusky, MI (US)

(73) Assignee: Strother Archery, Sandusky, MI (US)

( * ) Notice: Subject to any disclaimer, the term of this patent is extended or adjusted under 35 U.S.C. 154(b) by 0 days. days.

(21) Appl. No.: 14/211,790

(22) Filed: Mar. 14, 2014

(65) Prior Publication Data

US 2014/0283804 A1 Sep. 25, 2014

Related U.S. Application Data

(60) Provisional application No. 61/794,257, filed on Mar. 15, 2013.

(51) Int. Cl.

| | |
|---|---|
| ***F41B 5/00*** | (2006.01) |
| ***F41B 5/14*** | (2006.01) |
| ***F41B 5/10*** | (2006.01) |

(52) U.S. Cl.

CPC ..... *F41B 5/1403* (2013.01); *F41B 5/10* (2013.01)

(58) Field of Classification Search

CPC ..... F41B 5/00; F41B 5/20; F41B 5/10; F41B 5/14

USPC ..... 124/23.1, 25.6, 86, 88, 89

See application file for complete search history.

(56) References Cited

U.S. PATENT DOCUMENTS

| | | | | |
|---|---|---|---|---|
| 3,595,213 | A | 7/1971 | Storer | |
| 3,874,360 | A | 4/1975 | Armstrong et al. | |
| 3,981,290 | A * | 9/1976 | Islas | F41B 5/0005 124/25.6 |
| 4,244,345 | A | 1/1981 | Simo et al. | |
| 4,756,295 | A | 7/1988 | Guzzetta | |
| 4,955,354 | A * | 9/1990 | Bozek | F41B 5/10 124/23.1 |
| 5,720,267 | A * | 2/1998 | Walk | F41B 5/10 124/23.1 |
| 5,931,146 | A | 8/1999 | Schrader et al. | |
| 6,786,214 | B2 | 9/2004 | Andrews | |
| 6,941,937 | B2 | 9/2005 | Wheeler | |
| 7,082,937 | B1 | 8/2006 | Land | |
| 7,721,721 | B1 | 5/2010 | Kronengold et al. | |
| 7,784,452 | B1 | 8/2010 | Kronengold et al. | |
| 7,913,680 | B2 | 3/2011 | Evans | |
| 7,980,236 | B1 | 7/2011 | Kronengold et al. | |

(Continued)

FOREIGN PATENT DOCUMENTS

| | | |
|---|---|---|
| WO | WO-2001/94870 | 12/2001 |

*Primary Examiner* — Gene Kim

*Assistant Examiner* — Christopher Glenn

(74) *Attorney, Agent, or Firm* — Barclay Damon LLP

(57) ABSTRACT

Embodiments of a limb retainer system to secure bow limbs to a riser on an archery bow. The limb retainer system includes a first part and a second part that are disposed, respectively, on a front and a back of the riser to position the limb elements to retain a shooting string under tension. In one embodiment, the first part secure the limb elements in position on the riser. The second part is configured to rotate relative to the first part, thereby allowing an end user to adjust the tension of the bowstring. This configuration offer a robust, cost effective design that prevents unwanted movement of the bow limbs and preserves adjustment necessary for adequate tuning of the archery bow.

31 Claims, 10 Drawing Sheets

(56) References Cited

U.S. PATENT DOCUMENTS

| | | | | |
|---|---|---|---|---|
| 8,047,189 | B2 * | 11/2011 | McPherson | 124/23.1 |
| 8,281,773 | B2 | 10/2012 | Dahl, II et al. | |
| 8,776,770 | B2 * | 7/2014 | Batdorf | F41B 5/10 124/23.1 |
| 8,844,508 | B2 * | 9/2014 | Sims | F41B 5/10 124/25 |
| 2004/0094139 | A1 * | 5/2004 | Andrews | F41B 5/0026 124/23.1 |
| 2006/0011181 | A1 * | 1/2006 | Andrews | F41B 5/1426 124/23.1 |
| 2008/0127961 | A1 * | 6/2008 | McPherson | F41B 5/10 124/88 |
| 2010/0263650 | A1 * | 10/2010 | Dahl, II | F41B 5/10 124/25.6 |
| 2014/0041645 | A1 * | 2/2014 | Wasilewski et al. | 124/25.6 |

* cited by examiner

LIMB RETAINER SYSTEM AND ARCHERY BOW COMPRISED THEREOF

CROSS-REFERENCE TO RELATED APPLICATIONS

This application claims the benefit of U.S. Provisional Patent Application Ser. No. 61/794,257, filed on Mar. 15, 2013 and entitled "LIMB RETAINER SYSTEM AND ARCHERY BOW COMPRISED THEREOF," the content of which is incorporated by reference herein in its entirety.

BACKGROUND

The subject matter disclosed herein relates to archery bows and, in various embodiments, to structure that anchors bow limbs to the riser.

Designs for archery bows and, in particular, compound archery bows utilize bow limbs and pulleys to manage operating characteristics (e.g., draw weight, draw length, etc.) of the bowstring. These designs often secure the bow limbs to the riser in a manner that allows adjustment of the operating characteristics. An end user can use this adjustment to tune operation of the archery bow to match their personal attributes (e.g., strength, reach, shooting style, etc.).

The bow limbs can affect performance (e.g., shooting accuracy) of compound archery bows. Ideal operation of the bow limbs results in a single direction of motion, namely, even flexure toward and away from the midline of the riser. This motion allows the end user to effectively draw the bowstring in preparation for a shot. Moreover, limiting motion to this single direction is important upon release of the bowstring for the projectile (e.g., an arrow) to achieve a flight path that is accurate and repeatable. Twisting, shifting, and other movement of the bow limbs relative to the riser can adversely affect the flight path, thus degrading performance of the bow.

Compound bows employ various techniques to minimize movement of the bow limbs relative to the riser, while also permitting adjustments to personalize operation of the bow. Some designs bolt and/or fasten at an end of the bow limbs directly to the riser. In other designs, the riser may incorporate features and/or couple to parts that receive the end of the bow limb. These designs may form a pocket or cradle with sidewalls that are meant to prevent lateral (or "side-to-side") movement of the bow limb.

BRIEF DESCRIPTION OF THE INVENTION

This disclosure describes embodiments of a limb retainer system that can secure the bow limbs to the riser of an archery bow. As set forth in more detail below, these embodiments can include a first part and a second part, one each that are disposed on a front part and a back part of the riser. The first part is configured to secure to the riser, providing features that contact a first surface of the bow limbs to reduce, or effectively eliminate, movement of the bow limbs relative to the riser. The second part is configured to contact a second surface of the bow limbs. This configuration forms a pivot about which the blow limbs can rotate during operation of the archery blow. In one implementation, the second part can move relative to the first part and, notably, can rotate relative to a midline of the riser. This configuration of the first part and the second part offers a robust, cost effective design that prevents unwanted movement of the bow limbs and preserves adjustment necessary for adequate tuning of the archery bow.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION

The discussion below describes structure to attach limb retainers to the riser of an archery bow. This structure is configured to avoid twisting and/or other movement of the limb retainers relative to the riser. This feature can reduce errors in the flight path of an arrow that projects from the archery bow. Examples of the structure are also configured to permit adjustments to the mechanical operation of the bow. Notably, the configurations can allow an end users to manipulate the tension of the bowstrings. This feature permits the end user to achieve a more personalized operation of the archery bow.

Figure 1:
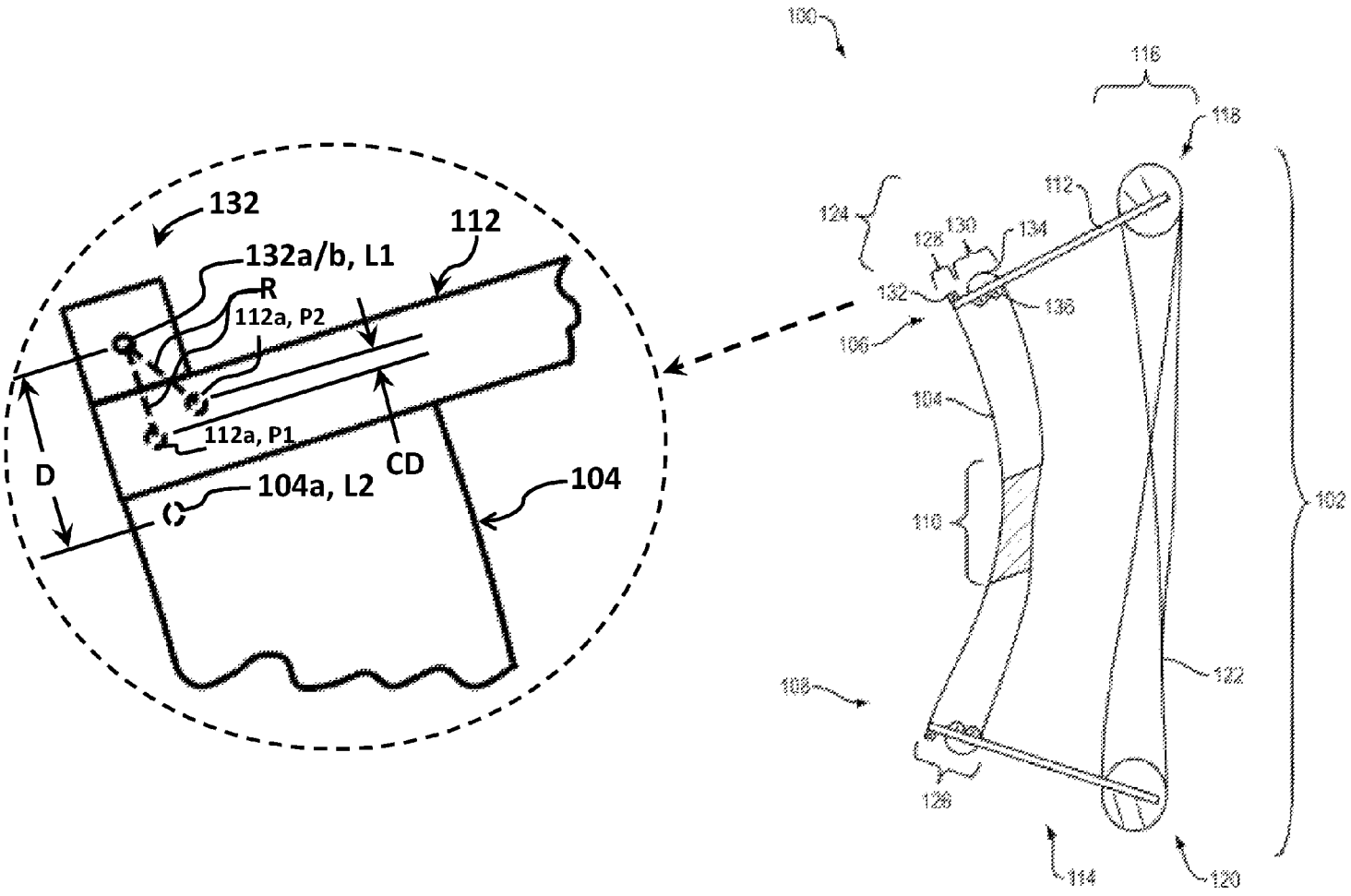
FIG. 1 depicts a schematic diagram of an exemplary embodiment of a limb retainer system as part of an exemplary compound bow.

FIG. 1 depicts a schematic diagram of an exemplary embodiment of a limb retainer system 100. The limb retainer system 100 is part of an archery bow 102, e.g., a compound archery bow. The archery bow 102 includes a riser 104 with a first end 106 and a second end 108. The riser 104 has a handle 110 (also, "grip 110") that an end user can grasp to steady, aim, and position the archery bow 102 to deliver a projectile (e.g., an arrow). The archery bow 102 also includes one or more limb assemblies (e.g., a first limb assembly 112 and a second limb assembly 114). The limb assemblies 112, 114 secure to the riser 104 at one end, via the limb retainer system 100, and support a cable system 116 at the other end. In one example, the cable system 116 includes one or more pulley assemblies (e.g., a first pulley assembly 118 and a second pulley assembly 120) and a bowstring 122 that winds about the pulley assemblies 118, 120.

As also shown in FIG. 1, the limb retainer system 100 includes a pair of retainer assemblies (e.g., a first retainer assembly 124 and a second retainer assembly 126). The retainer assemblies 124, 126 include a first part 128 (also, "front part 128") and a second part 130 (also, "back part 130") that reside proximate, respectively, the front and the back of the riser 104. The front part 128 includes a front retainer element 132 that couples to the limb assemblies 112, 114 and to the riser 104. The back part 130 includes a lever element 134 and a rocker element 136, which in one example secures to the lever element 134. Front retainer element 132, in an embodiment, includes a retainer portion 132*a* (e.g., a pivot member or pin element) extending along axis 132*b* and positioned at location L1. The retainer portion 132*a* is located at a distance D away from the location L2 of a riser portion 104*a* of riser 104. The end of limb 112 has a limb portion 112*a*. The limb portion 112*a* is located at a radius R away from the location L1 of the retainer portion 132*a*. When front retainer element 132 is rotated counter-clockwise relative to the riser 104, the limb portion 112*a* moves from position P1 to position P2. This causes the limb portion 112*a* to have a change in distance CD from the location L2 of the riser portion 104*a*.

Embodiments of the limb retainer system 100 secure the limb assemblies 112, 114 in a manner that prevents movement other than in a direction toward the midline of the riser 104. The lever element 134 and the rocker element 136 work together with one another and the limb assemblies 112, 114 to adjust tension of the bowstring 122. Collectively, the features of the limb retainer system 100 offer favorable operation of the archery bow 102, e.g., to maintain accurate and repeatable projective flight. As compared to conventional designs, construction of the limb retainer system 100 can minimize the effects of tolerance stack-up in the overall assembly of the archery bow 102. In one embodiment, the limb retainer system 100 features a two part design (e.g., the front part 128 and the back part 130); however this disclosure does contemplated other embodiments in which the front part 128 and the back part 130 are configured as a single, monolithic unit.

When assembled to the archery bow 102, the front part 128 secures the limb assemblies 112, 114 directly to the rise 104. The back part 130 supports the limb assemblies 112, 114 and, moreover, incorporates features that permit adjustment, e.g., to the tension of the bowstring 122. This configuration of the front part 128 and the back part 130 offers a structure that both allows an end user to tune operation of the archery bow 102 and that ensures appropriate rigidity to prevent the limb assemblies 112, 114 from twisting and/or rotating during operation of the archery bow 102.

Figure 2:
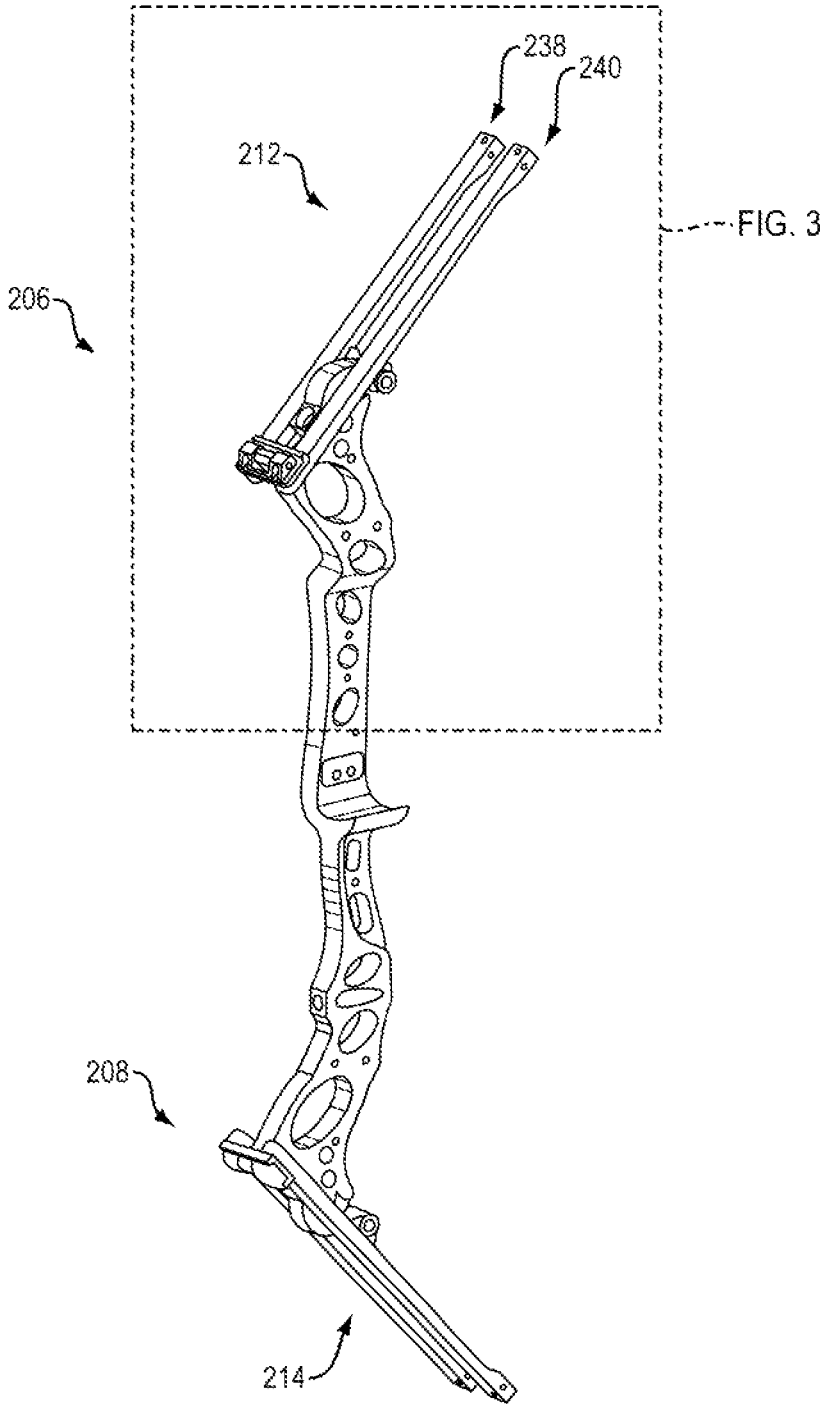
FIG. 2 depicts a perspective view of an exemplary embodiment of a limb retainer system as part of an exemplary compound bow.
Figure 3:
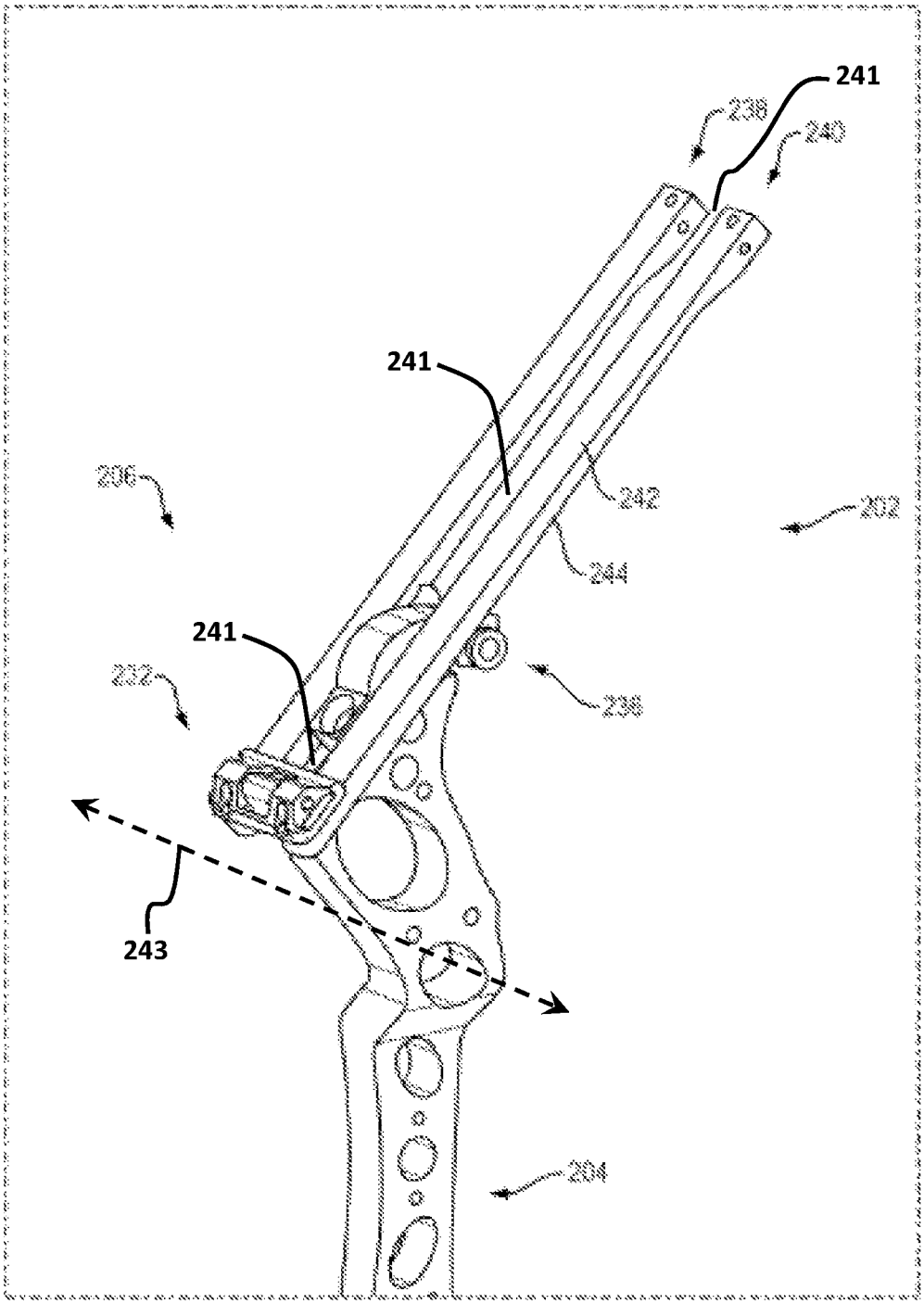
FIG. 3 depicts a detail, perspective view of the limb retainer system of FIG. 2.

FIGS. 2 and 3 depict another exemplary embodiment of a limb retainer system 200. In FIG. 2, the limb assemblies 212, 214 include one or more limb elements (e.g., a first limb element 238 and a second limb element 240). This arrangement of the limb elements 212, 214 embodies a "split limb" design that utilizes a pair of substantially separate and parallel spaced-apart limb elements 238, 240, which are separated by a gap 241 extending in a lateral direction 243. Embodiments of the limb retainer system 200 can accommodate other designs that may incorporate other configurations of the limb elements, e.g., the limb elements 238, 240 as a single unitary member and/or configurations in which the limb elements 238, 240 couple with one another.

As best shown in FIG. 3, the limb elements 238, 240 have an upper surface 242 and a lower surface 244. The limb retainer system 200 mounts to the riser 204 in a manner that positions the first part or front retainer element 232 proximate the upper surface 242 and the limb support or rocker element 236 proximate the lower surface 244. This configuration of the rocker element 236 forms a pivot to promote bending of the limb elements 238, 240. During operation of the archery bow 202, this pivot allows the limb elements 238, 240 to flex as the end user draws back on the bowstring (e.g., bowstring 122 of FIG. 1).

The front retainer element 232 can have one or more features that can receive the end of the limb elements 238, 240. The example of FIG. 3 illustrates one configuration of features in which the upper surface 242 of the limb elements 212, 214 mates and/or contacts the bottom surface of the front retainer element 232. However, in other examples, the front retainer element 232 may include features that contact and/or mate with front and/or lateral surfaces of the limb elements 238, 240. These other features may help to stabilize the limb elements 238, 240 to further reduce the opportunity for movement of the limb elements 238, 240 relative to the riser 204 to occur, e.g., during operation of the archery bow 202. In one embodiment, the limb retainer system 200 can include one or more fasteners (e.g., screws, bolts, etc.) that penetrate through the limb elements 238, 240 to secure the limb elements 238, 240 to the front retainer element 232. In addition to, or in lieu of these fasteners, the limb retainer system 200 may also utilize fastening techniques, e.g., adhesives and/or bonding agents, to secure the limb elements 238, 240.

Figure 4:
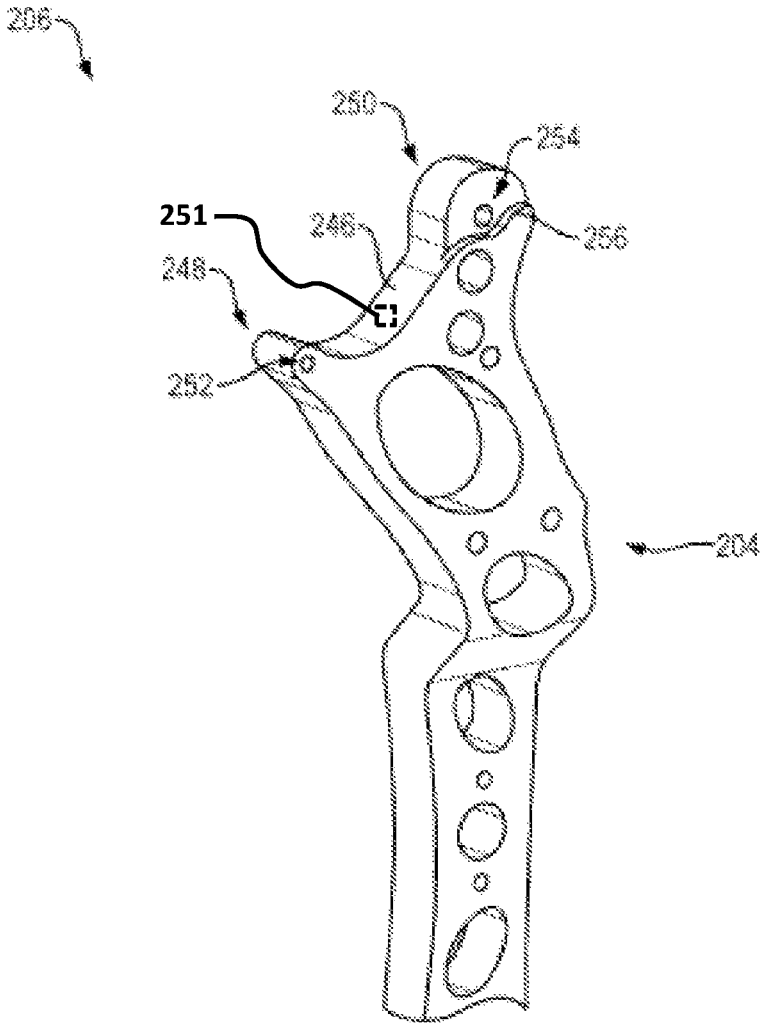
FIG. 4 depicts a detail, perspective view of a riser as shown on the limb retainer system of FIG. 2.

FIGS. 4, 5, 6, 7, 8, 9, and 10 depict the retainer system 200 in various states of assembly to describe details and/or exemplary configurations for the parts used therein. FIG. 4 depicts the riser 204 to focus the discussion, for example, on the configuration of the ends (e.g., the first end 206 and/or the second end 208 (FIG. 2)). As shown on the end 206, the riser 204 includes an end surface 246 and one or more boss elements (e.g., a riser segment or front boss element 248 and an arc-shaped segment or rear boss element 250). The boss elements 248, 250 provide an interface to secure one or more parts of the limb assemblies to the riser 204. To facilitate this interface, the riser 204 includes one or more openings (e.g., a front opening 252 and a rear opening 254) that penetrate through the boss elements 248, 250. The riser 204 also forms a support surface 256 proximate the rear boss element 250.

Figure 5:
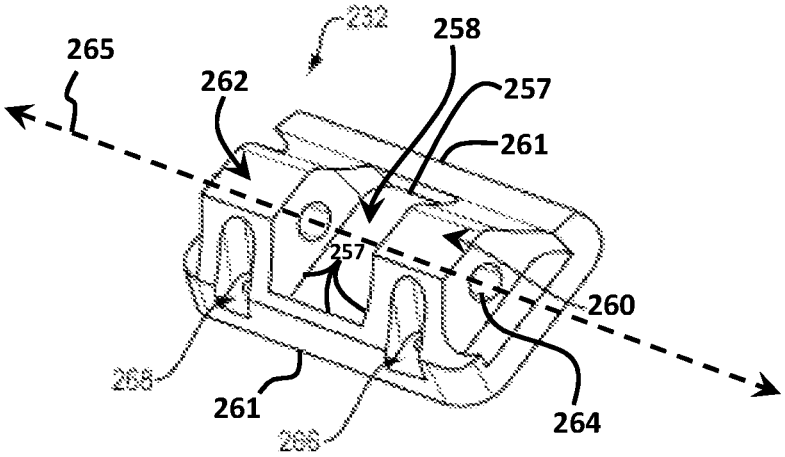
FIG. 5 depicts a detail perspective view of a front retainer element in position on the riser as shown on the limb retainer system of FIG. 2.

FIG. 5 illustrates an example of the front retainer element 232. As shown in this diagram, the front retainer element 232 has: (a) a pass-through opening or boss opening 258 defined by a window 257; (b) lateral members (e.g., a first lateral member 260 and a second lateral member 262); and (c) intermediary portions 261. The front retainer element 232 also has a first bore 264 (extending along first axis 265) that penetrates through the first lateral member 260 and, in one example, through the second lateral member 262. The front retainer element 232 can also include one or more limb fastening openings (e.g., first limb fastening opening 266 and a second limb fastening opening 268). Examples of the limb fastening openings 266, 268 may include threads to receive complementary fasteners that secure limb elements (e.g., limb elements 248, 250 of FIGS. 2 and 3) to the bottom of the front retainer element 232, e.g., as discussed in connection with FIGS. 2 and 3 above.

Figure 6:
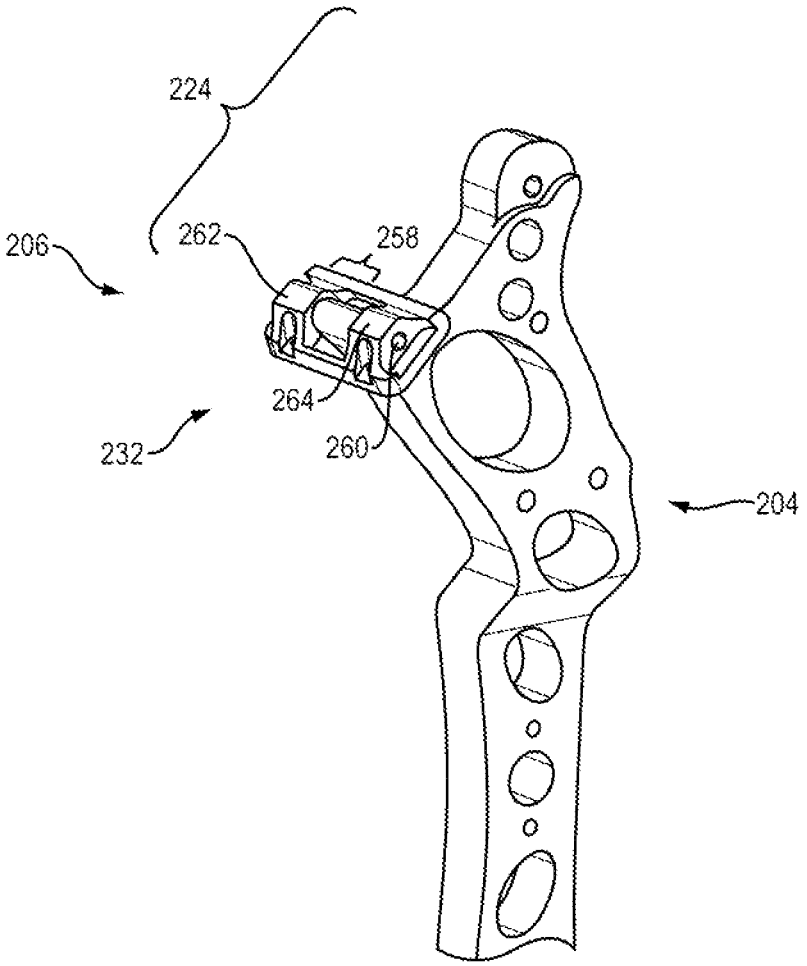
FIG. 6 depicts a perspective view of the front retainer element of FIGS. 2 and 5.

FIG. 6 illustrates the retainer assembly 224 with the front retainer element 232 in position on the front boss element 248. The limb retainer system 200 may include a first pivot member or front pin element (also "shaft element") that resides in the first bore 264 and the front opening 252 (FIG. 4). This front pin element secures the front retainer element 232 to the front boss element 248, e.g., using a slip fit, press fit, and/or interference fit between the outer diameter of pin element and the front opening 252 (FIG. 4) and the first bore 264. This configuration prevents, or reduces, any relative movement between the riser 202 and the front retainer element 232. In one implementation, the secure fit between the riser 202 and the front retainer element 232 secures the limb elements directly to the riser 202, albeit through connection of the limb elements with the front retainer element 232 as noted herein. The limb retainer system 200 may utilize one or more clips (e.g., e-clips, pins, cotter pins, etc.) to secure to the ends of the front pin element, e.g., on the outside of the lateral members 260, 262. These clips can provide a rigid structure to prevent movement of the front pin element that may cause the front retainer element 232 to dislocate from the front boss element 204.

This disclosure does contemplate other embodiments in which the riser 202 may integrate (and/or incorporate) one or more features of the front retainer element 232. This construction may compliment features of the front retainer element 232 to secure the limb elements in position on the archery bow 202. For example, the boss element 248 may include one or more surfaces that can interface with the limb elements, in addition to or in lieu of, corresponding features on the front retainer element 232.

Examples of the boss opening 258 can have dimensions to receive the front boss element 248 into the body of the front retainer element 232. These dimensions may position the inner lateral walls of the lateral members 260, 262 in close proximity to the exterior lateral walls of the front boss element 248. In one example, the dimensions may create a press and/or interference fit that helps to secure the front retainer element 232 onto the front boss element 248.

Figure 7:
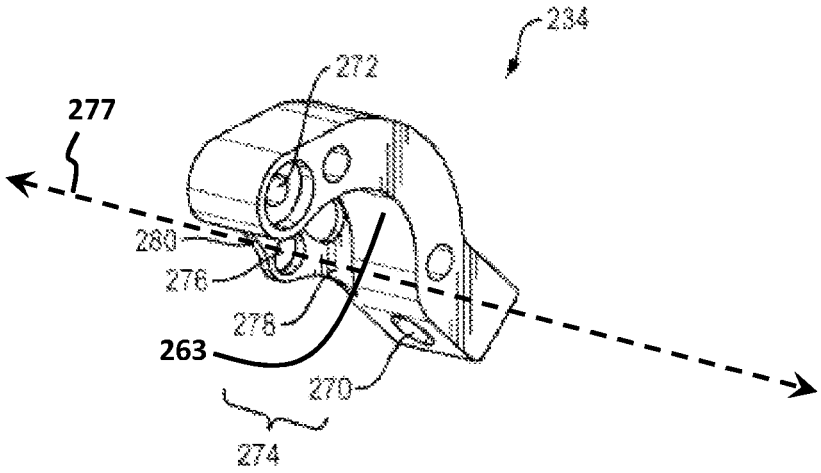
FIG. 7 depicts a detail, perspective view of a lever element in position on the riser as shown on the limb retainer system of FIG. 2.

FIG. 7 illustrates a bottom, perspective view of the exemplary pivotal element or lever element 234. Generally, geometry for the lever element 234, which defines arc-shaped cavity 263, is configured to interface with corresponding geometry on the riser. This geometry may take many forms, the selection of which may consider certain aesthetic, dimensional, and like design restriction. In the example of FIG. 7, the lever element 234 has a passageway or forward opening 270 and a rear lateral opening 272. The lever element 234 also has a lateral pivot element 274 that forms a pivot opening 276 (located on second axis 277) and a lateral pivot wall 278 with a bottom pivot surface 280.

Figure 8:
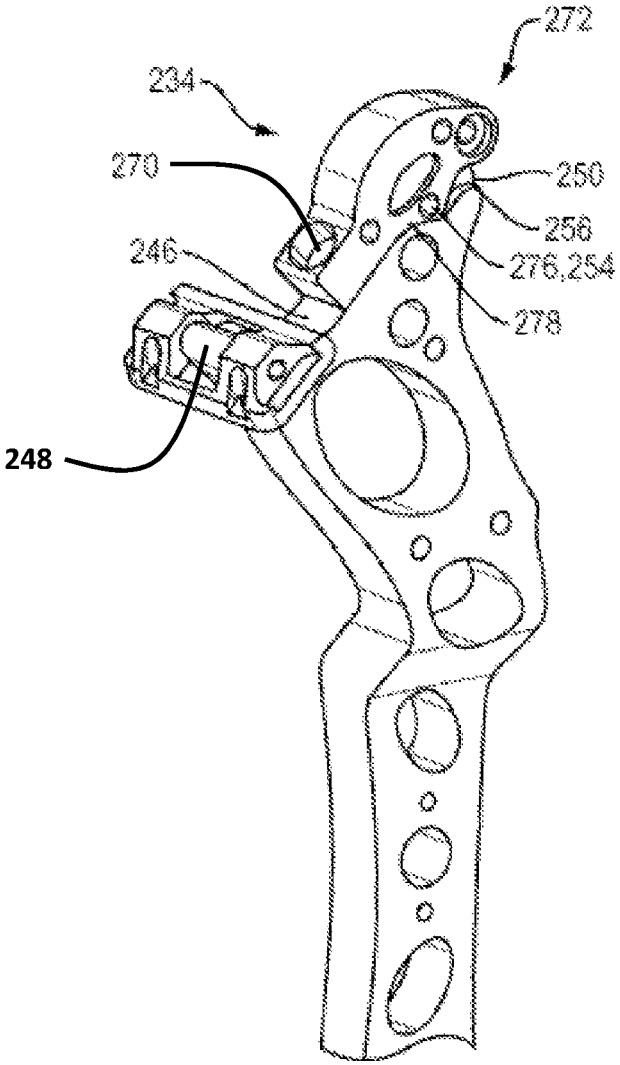
FIG. 8 depicts a perspective view of the lever element of FIGS. 2 and 7.

As best shown in FIG. 8, in which the lever element 234 is in position on the rear boss element 250, the lateral pivot wall 278 mates and/or contacts a lateral surface of the rear boss element 250. In one example, the bottom pivot surface 280 contacts the support surface 256 to provide added support to the limb system 100, e.g., when under tension by the bowstring (e.g., bowstring 122 of FIG. 1). The configuration of the lever element 234 and the rear boss element 250 aligns the pivot opening 276 with the rear opening 254 on the rear boss element 250. The limb retainer assembly 200 may include a second pivot member or pivot pin (and/or pivot shaft) and/or other fastener that resides in the pivot opening 276 and the rear opening 254. This pivot pin couples with lever element 234 with the riser 204. Embodiment of the limb retainer system 200 may also include a tension adjuster, position controller or fastener 247 (FIG. 9) (e.g., a screw, bolt, etc.) having a second threaded portion 249 that resides in the forward opening 270. This fastener 247 may engage an opening in the riser 204, e.g., a threaded opening disposed on the end surface 246, which has a first threaded portion 251 (FIG. 4).

Figure 9:
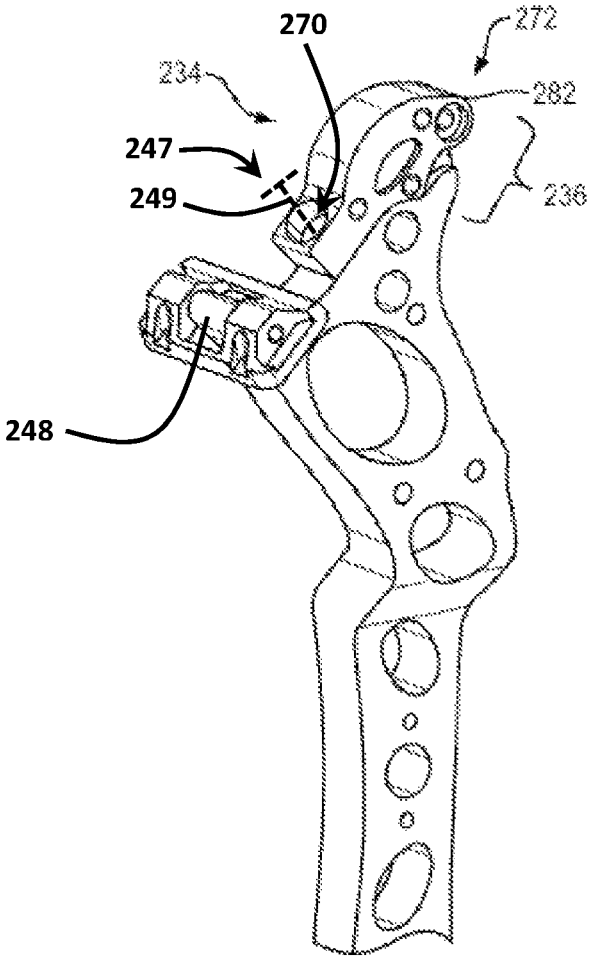
FIG. 9 depicts a detail, perspective view of a pivot element in position on the lever element as shown on the limb retainer system of FIG. 2.
Figure 10:
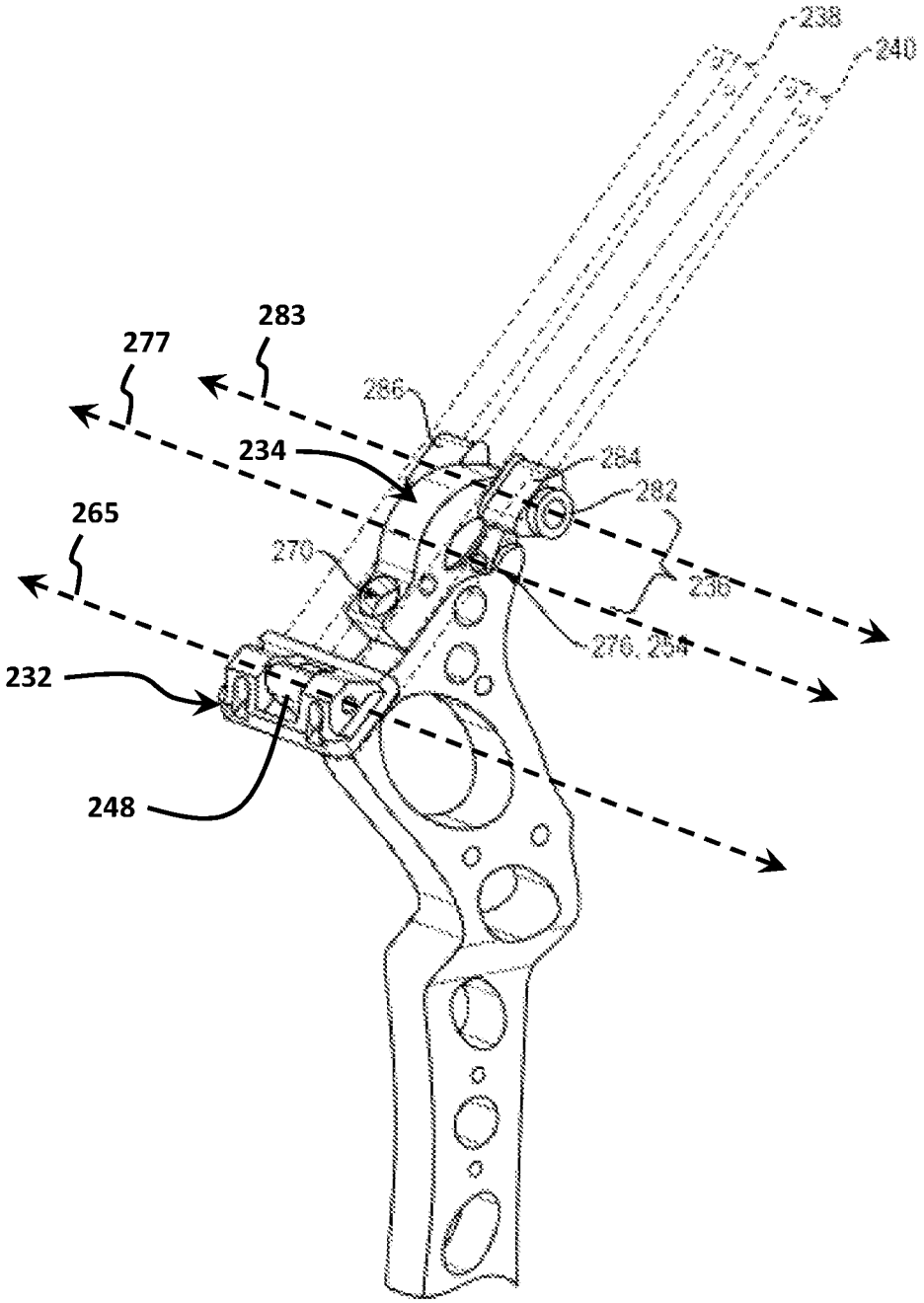
FIG. 10 depicts a detail, perspective view of rocker elements in position on the pivot element as shown on the limb retainer system of FIG. 2.

FIGS. 9 and 10 depict the retainer assembly 224 with the rocker element 236 in position on the lever element 234. In FIG. 9, the rocker element 236 includes a shaft element 282 that extends along third axis 283 through the rear lateral opening 272 of the lever element 234. The diagram of FIG. 10 shows the rocker element 236 with one or more limb supports or rockers (e.g., a first rocker 284 and a second rocker 286) disposed on the shaft element 282. In one implementation, the limb supports or rockers 284, 286 include a surface that contacts the lower surface of the limb elements 238, 240. This surface can offer support to the limb elements 238, 240; as noted above, the configuration of the rockers 284, 286 can form the pivot about which the limb elements 238, 240 will bend during operation of the archery bow.

Manipulation of the fastener 247 for use in the forward opening 270 can adjust the pitch of the lever element 234 relative to the midline of the riser 204. In one example, the pin element disposed in the pivot opening 276 and the rear opening 254 forms a pivot about which the lever element 234 can rotate in response to changes in the position of the fastener in the forward opening 270. Drawing the fastener 247 towards and away from the end surface 246, will change the pitch of the lever element 234. This feature, in turn, will change the flexure in the limb element 238, 240.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A limb retainer system comprising:

a first part configured to be pivotally coupled to a plurality of front limb ends of a plurality of bow limb elements, wherein the bow limb elements are configured to be coupled to a riser of an archery bow so that there is a gap between the front limb ends of the bow limb elements, wherein the riser comprises: (a) a front face configured to face toward a target, a back face opposite of the front face, a plurality of sides, and a thickness extending in a lateral direction from one of the sides toward another one of the sides; and (b) a riser end, the riser end comprising a front portion, a back portion and a first threaded portion, wherein the first part comprises:

a first lateral member configured to be coupled to a first one of the front limb ends;

a second lateral member configured to be coupled to a second one of the front limb ends; and a plurality of intermediary portions that at least partially define an opening configured to receive a riser segment of the riser end, wherein the intermediary portions are configured to extend across the gap between the first and second front limb ends when the first part couples the first and second front limb ends to the riser end;

a first pivot member configured to pivotally couple the first part to the front portion of the riser end so that the first part is pivotal about a first axis extending in the lateral direction, the first pivot member configured to be positioned at a location relative to the front portion of the riser end;

a second part configured to be pivotally coupled to the back portion of the riser end and spaced apart from the first part, the second part configured to receive a force derived from one or more of the bow limb elements, wherein the second part comprises a lever element, wherein the lever element defines: (a) a passageway extending entirely through the lever element; (b) a first lever opening located on a second axis extending in the lateral direction; and (c) a second lever opening located on a third axis extending in the lateral direction, wherein the first and second axes are spaced apart from each other;

a second pivot member configured to be at least partially inserted into the first lever opening and engaged with a first portion of the riser end, wherein the second pivot member extends along the second axis;

a plurality of rocker elements comprising first and second rocker elements, wherein each one of the rocker elements defines a rocker opening;

a third pivot member configured to be at least partially inserted into the rocker openings and at least partially inserted into the second lever opening, wherein the third pivot member extends along the third axis; and a tension adjuster which is adjustably coupled to the second part, the tension adjuster configured to be adjusted between a plurality of different positions relative to the second part while the tension adjuster is coupled to the second part, wherein the tension adjuster is configured to extend through the passageway to make contact with the riser end, wherein the tension adjuster comprises a second threaded portion configured to mate with the first threaded portion, wherein the mating is configured to enable an incremental movement of the tension adjuster relative to the lever element, wherein, in response to the incremental movement while the limb retainer system is coupled to the riser end, the lever element is configured to pivot about the second axis, which causes the rocker elements to move relative to the riser end, which causes a force on the bow limb elements, which causes the first part to pivot about the first axis, wherein the first pivot member is configured to remain at the location during the incremental movement, wherein the first part is configured so that the first axis is a sole axis about which the first and second front limb ends are pivotal, wherein the first rocker element is configured to pivot independent of the second rocker element in response to different forces applied by the bow limb elements.

2. The limb retainer system of claim 1, wherein the first part comprises a front retainer element.

3. The limb retainer system of claim 1, wherein the first and second pivot members each comprise a pin element.

4. The limb retainer system of claim 1, wherein:

the tension adjuster is structured to cause an adjustment of tension in a bowstring coupled to the bow limb elements;

the first pivot member is configured to remain at the location throughout the adjustment of tension; and the pivoting of the front limb ends excludes any sliding movement of the front limb ends relative to the riser.

5. The limb retainer system of claim 1, wherein the lever element defines an arc-shaped cavity configured to receive an arc-shaped segment of the riser end.

6. The limb retainer system of claim 1, wherein the tension adjuster comprises a screw.

7. The limb retainer system of claim 1, wherein the tension adjuster comprises a fastener.

8. The limb retainer system of claim 1, wherein the tension adjuster comprises: (a) a first surface corresponding to a first one of the positions; and (b) a second surface corresponding to a second one of the positions.

9. The limb retainer system of claim 8, wherein the first and second surfaces are portions of a plurality of thread surfaces of the tension adjuster.

10. The limb retainer system of claim 1, wherein:

the tension adjuster is configured to enable adjustment of a bowstring tension level;

the first pivot member is configured to remain at the location throughout the adjustment of the bowstring tension level;

the front limb end comprises a limb portion;

the limb portion is positioned apart from the location by a radius;

the riser comprises a riser portion;

during rotation of the limb portion relative to the riser portion, the limb portion has a change in distance from the riser portion;

the change in distance is caused by a magnitude of the radius; and the rotation of the limb portion excludes any sliding movement of the limb portion relative to the riser.

11. The limb retainer system of claim 1, wherein:

the front part of the riser comprises a forward-most portion; and the first pivot member is configured to pivotally couple the first part to the forward-most portion.

12. An archery bow comprising:

a riser comprising a front face, a back face, a plurality of sides, a thickness extending in a lateral direction from one of the sides toward another one of the sides, and an end having a front part and a back part;

a retainer element pivotally mounted to the front part of the riser, the retainer element being pivotal about a first axis extending in the lateral direction, the retainer element being configured so that the first axis is positioned at a location relative to the front part of the riser;

at least one limb element having a front limb end, the at least one limb element being coupled to the retainer element, the at least one limb element configured to receive a force of a bowstring;

a lever element moveably coupled to the back part of the riser and spaced apart from the retainer element, the lever element configured to be pivoted about a second axis between first and second positions relative to the riser, wherein the second axis extends in the lateral direction; and at least one limb support that is pivotally coupled to the lever element, the at least one limb support configured to be pivoted about a third axis, wherein the third axis extends in the lateral direction; and a tension adjuster configured to:

(a) reposition the lever element from the first position to the second position; and (b) secure the lever element in the second position, wherein the lever element is configured to cause a repositioning of the at least one limb element in response to the movement to the second position, the repositioning of the at least one limb element causing a change in tension of the bowstring, wherein the retainer element is configured so that the first axis remains at the location during the repositioning of the at least one limb element, wherein the retainer element is configured so that the first axis is a sole axis about which the front limb end is pivotal.

13. The archery bow of claim 12, wherein the archery bow comprises:

a plurality of limb elements that are spaced apart from each other in side by side fashion; and a plurality of limb supports comprising first and second limb supports, wherein each of the limb supports is configured to be: (a) pivotally coupled to the lever element; and (b) pivotal about the third axis, wherein, while the lever element is secured in the second position, the first limb support is configured to pivot independent of the second limb support due to movement of one or more of the limb elements.

14. The archery bow of claim 13, wherein:

the lever element defines a passageway extending entirely through the lever element;

the end of the riser comprises a first threaded portion;

the tension adjuster is configured to extend through the passageway to make contact with the end of the riser;

the tension adjuster comprises a second threaded portion configured to mate with the first threaded portion; and the mating is configured to enable an incremental movement of the lever element relative to the end of the riser.

15. The archery bow of claim 12, wherein the retainer element comprises a window that defines a pass-through opening, wherein the pass-through opening is configured to receive a portion of the end of the riser.

16. The archery bow of claim 12, wherein:

the archery bow comprises a plurality of limb elements that are spaced apart from each other in side by side fashion so that there is a gap between the limb elements; and the retainer element comprises:

a first lateral member configured to be coupled to a first end of a first one of the limb elements;

a second lateral member configured to be coupled to a second end of a second one of the limb elements; and a plurality of intermediary portions that at least partially define an opening configured to receive a portion of the end of the riser, wherein the intermediary portions are configured to extend across the gap between the limb elements when the retainer element couples the limb elements to the end of the riser, wherein the intermediary portions are configured to reduce movement of the first end of the first limb element relative to the second end of the second limb element.

17. The archery bow of claim 12, wherein:

the front part of the riser comprises a forward-most portion; and the retainer is pivotally mounted to the forward-most portion.

18. A limb retainer system comprising:

a first part configured to be coupled to at least one limb element of an archery bow, wherein the first part is configured to pivot about a first axis, the first axis being extendable through a thickness of a bow riser of the archery bow, the bow riser having an end, a front face, a back face and a plurality of sides, the thickness extending from one of the sides toward another one of the sides;

a pivot member configured to pivotally mount the first part to the end of the bow riser, the pivot member configured to extend along the first axis at a location relative to the end of the bow riser;

a second part, spaced apart from the first part, the second part configured to be moveably mounted to the end of the bow riser, wherein the second part is configured to pivot about a second axis;

at least one limb support pivotally coupled to the second part, wherein the at least one limb support is configured to: (a) support the at least one limb element; and (b) pivot about a third axis; and a tension adjuster moveably coupled to the second part, the tension adjuster comprising an engager configured to:

(a) engage the second part;

(b) reposition the second part from a first position relative to the end of the bow riser to a second position relative to the end of the bow riser; and (c) secure the second part in the second position, wherein the tension adjuster is associated with a plurality of different bowstring tension levels, wherein the pivot member remains at the location during the movement of the tension adjuster.

19. The limb retainer system of claim 18, wherein: (a) the first part comprises a front retainer element; (b) the pivot member comprises a pin element; and (c) the second part comprises a lever element.

20. The limb retainer system of claim 18, wherein the second part defines a passageway extending entirely through the second part;

the end of the bow riser comprises a first threaded portion;

the engager of the tension adjuster is configured to extend through the passageway to make contact with the end of the bow riser;

the engager of the tension adjuster comprises a second threaded portion configured to mate with the first threaded portion; and the mating is configured to enable an incremental movement of the second part relative to the end of the bow riser.

21. The limb retainer system of claim 18, wherein the archery bow comprises a plurality of limb elements that are spaced apart from each other in side by side arrangement; and the limb retainer system comprises first and second limb supports, wherein each of the first and second limb supports is configured to be: (a) pivotally coupled to the second part; and (b) pivotal about the third axis, wherein, while the second part is secured in the second position, the first limb support is configured to pivot independent of the second limb support due to movement of one or more of the limb elements.

22. The limb retainer system of claim 18, wherein the engager of the tension adjuster comprises: (a) first surface configured to engage the end of the bow riser; (b) a second surface configured to engage the second part, the second surface corresponding to the first position; and (c) a second surface configured to engage the second part, the second surface corresponding to the second position.

23. The limb retainer system of claim 18, wherein:

the archery bow comprises a plurality of limb elements that are spaced apart from each other in side by side fashion so that there is a gap between the limb elements; and the first part comprises:

a first lateral member configured to be coupled to a first end of a first one of the limb elements;

a second lateral member configured to be coupled to a second end of a second one of the limb elements; and a plurality of intermediary portions that at least partially define a pass-through opening configured to receive a portion of the end of the bow riser, wherein the intermediary portions are configured to extend between the limb elements when the first part is coupled to the limb elements, wherein the intermediary portions are configured to reduce movement of the first end of the first limb element relative to the second end of the second limb element.

24. The limb retainer system of claim 18, wherein the second part defines an arc-shaped cavity configured to receive an arc-shaped segment of the end of the riser.

25. The limb retainer system of claim 18, wherein:

the end of the bow riser comprises a forward-most portion; and the first part is mounted to the forward-most portion.

26. A limb retainer system comprising:

a limb coupler structured to pivotally couple a limb end of a limb of an archery bow to a front portion of a riser end of the archery bow so that the coupled limb end is pivotal about a first axis that extends through the riser end, wherein the riser end comprises a front surface structured to face toward a shooting target and a plurality of side surfaces, the first axis extending in a lateral direction from one of the side surfaces toward another one of the side surfaces;

a pivotal element structured to be pivotally coupled to the riser end so that the pivotal element is pivotal about a second axis that extends in the lateral direction;

a limb support structured to be pivotally coupled to the pivotal element so that the limb support is moveable about a third axis that extends in the lateral direction; and a position controller movably coupled to the pivotal element, wherein, when the limb end is supported by the riser end:

(a) the pivotal element is structured to pivot about the second axis from a first position relative to the riser end to a second position relative to the riser end, the pivoting being due to movement of the position controller;

(b) the limb support is structured to move relative to the riser end due to the pivoting of the pivotal element, causing the limb to move relative to the riser end;

(c) the position controller is structured to secure the pivotal element in the second position; and (d) the limb coupler is structured to pivot about the first axis due to the movement of the limb.

27. The limb retainer system of claim 26, wherein: (a) the limb coupler comprises a front retainer element; (b) the pivotal element comprises a lever element; and (c) the limb support comprises a rocker element.

28. The limb retainer system of claim 26, wherein:

the pivotal element defines a passageway extending entirely through the pivotal element;

the riser end comprises a first threaded portion;

the position controller is configured to extend through the passageway to make contact with the riser end;

the position controller comprises a second threaded portion configured to mate with the first threaded portion; and the mating is configured to enable an incremental movement of the pivotal element relative to the riser end.

29. The limb retainer system of claim 28, wherein the position controller comprises an engagement portion structured to be inserted through the passageway to engage the riser end, the position controller being structured to operate in a plurality of control settings comprising:

(a) a first control setting wherein the limb support maintains the first position during operation of the archery bow, the first position being associated with a first bowstring tension; and (b) a second control setting wherein the limb support maintains the second position during operation of the archer bow, the second position being associated with a second bowstring tension which is different from the first bowstring tension.

30. The limb retainer system of claim 26, wherein:

the archery bow comprises a plurality of limb elements that are spaced apart from each other in side by side fashion; and the limb retainer system comprises first and second limb supports, wherein each of the first and second limb supports is structured to be: (a) pivotally coupled to the pivotal element; and (b) pivotal about the third axis, wherein, while the pivotal element is secured in the second position, the first limb support is structured to pivot independent of the second limb support in response to movement of one or more of the limb elements.

31. The limb retainer system of claim 26, wherein:

the archery bow comprises a plurality of limb elements that are spaced apart from each other in side by side fashion so that there is a gap between the limb elements; and the limb coupler comprises:

a first lateral member configured to be coupled to a first end of a first one of the limb elements;

a second lateral member configured to be coupled to a second end of a second one of the limb elements; and a plurality of intermediary portions that at least partially define an opening configured to receive a portion of the end of the riser, wherein the intermediary portions are configured to extend across the gap between the limb elements when the limb coupler couples the limb elements to the riser end of the archery bow, wherein the intermediary portions are configured to reduce movement of the first end of the first limb element relative to the second end of the second limb element.

* * * * *